United States Patent [19]
Johnsen
[11] 4,090,447
[45] May 23, 1978

[54] DIRECTIONAL BLASTING TUBES AND METHOD OF USE

[76] Inventor: Oscar A. Johnsen, R.R. #1, Site 4, Box 27, Sparwood, British Columbia, Canada

[21] Appl. No.: 758,551

[22] Filed: Jan. 11, 1977

Related U.S. Application Data

[63] Continuation of Ser. No. 569,404, Apr. 18, 1975, abandoned.

[30] Foreign Application Priority Data

Feb. 26, 1975 Canada ..... 220848

[51] Int. Cl.² ..... F42D 1/02

[52] U.S. Cl. ..... 102/23; 102/24 R; 86/20 C

[58] Field of Search ..... 102/20, 22–24; 86/20 C

[56] References Cited

U.S. PATENT DOCUMENTS

| | | | |
|---|---|---|---|
| 337,492 | 3/1886 | Hadesty | 86/20 C |
| 2,903,969 | 9/1959 | Kolbe | 86/20 C |
| 3,099,216 | 7/1963 | Jakobsen et al. | 102/22 |
| 3,349,705 | 10/1967 | Wilson | 102/24 |

*Primary Examiner*—Verlin R. Pendegrass

[57] ABSTRACT

A method and device for the directional blasting of rock and other materials. A blasting tube, the cross-sectional shape of which is crescent shaped, has a substantially rigid elongated body with a longitudinal air space therein and a wall to separate an explosive charge from the air space. Preferably, the wall is concave and the cross section of the air space is also crescent shaped. After the bore hole is drilled, the tube and the explosive material is inserted into the bore hole with the air cushion provided by the tube being oriented in the hole between the explosive charge and one side of the bore hole in a direction relative to the explosive charge opposite to which the maximum breaking and shattering forces are desired. The explosive charge can then be detonated without the use of stemming material other than the usual material to plug the outer end of the bore hole. When the explosive charge consists of individual elements of cylindrical form, the charge can be attached to the blasting tube prior to insertion thereof into the hole. The concave exterior portion of the tube is then adapted to hold the cylindrical charge.

23 Claims, 6 Drawing Figures

DIRECTIONAL BLASTING TUBES AND METHOD OF USE

This is a Continuation, of application Ser. No. 569,404, filed Apr. 18, 1975, and now abandoned.

BACKGROUND OF THE INVENTION

This invention relates generally to a method and apparatus for directional blasting for use in the mining and construction industries and like operations.

In the present state of the art of blasting, a drill hole is filled with explosives which are ignited resulting in the blow-out coming to where there is the least resistance, in other words to the nearest face of the rock. The difficulty is that the explosion also shatters or weakens the rock structure above or beyond the drill hole and in the opposite direction from which it is desired the explosion should take place. This necessitates a considerable amount of timbering up of ceilings, walls etc., to provide support to those areas damaged by the explosion. The idea of the present invention is to direct the blasting effect in a desired direction thereby causing as little damage as possible to the adjacent rock areas.

Some techniques of directional blasting are known in the art. However in the present state of the art, blasting tubes are inserted into bore holes, and the blasting tubes are required to be filled with stemming material (such as water or sand etc.) when the tube is placed in position in the bore hole prior to detonation. In the prior art, metallic or thermoplastic materials are used in construction of the blasting tubes. The principle they work on is that the stemming material receives a portion of the explosive force while the material to be blasted receives the other portion of the explosive force, thereby directing the blast in the direction opposite to which the stemming material is oriented in the bore hole. The prior art is inadequate in that the degree of success was minimal and it requires transportation to the blasting site of stemming material such as water, sand etc., and the need for a time consuming filling operation whereby the blasting tube is filled with the stemming material. Also, at least one end of the blasting tubes, in the prior art, is required to be closed in order to contain the stemming material.

SUMMARY OF THE INVENTION

In accordance with the present invention, there is provided a method of blasting material comprising the steps of inserting an elongated, substantially rigid tube having a crescent-shaped exterior cross-section and an explosive charge into a bore hole, said rigid tube having an air space therein extending substantially the length thereof, said air space being crescent-shaped in cross-section and being oriented in said hole between said explosive charge and one side of said bore hole in a direction relative to said explosive charge opposite to which the maximum breaking and shattering forces are desired, and detonating said explosive charge.

In accordance with the present invention, there is also provided a blasting tube, the cross-sectional shape of which is crescent-shaped, having a substantially rigid elongated body with a longitudinal air space therein and means to maintain an explosive charge from said air space, said maintaining means including a concave exterior portion of the blasting tube, and wherein the cross-section of the air space is crescent-shaped.

An object of the directional blasting tube of the present invention is to provide a blasting tube which may be made of inexpensive materials such as semi-stiff plastic pipe and which at the same time can effectively direct the force of the blast.

Not only can the blasting tubes of the invention be used for precise directional blasting but they are also useful where directional blasting per se is not required. Often in blasting operations it is necessary to set off a series of charges one after the other to obtain the desired effect and sometimes this operation is unsuccessful because at least some of the charges are detonated prematurely by the force of the blasts from adjacent charges.

Accordingly another object of the invention is to provide a device and a method whereby the force of preceding blasts can be directed away from adjacent charges, thus preventing premature detonation. Finally even where premature detonation might not be a problem the present blasting tubes can be used to protect adjacent drill holes or charges from being damaged or rendered ineffective or useless by earlier blasts.

A further object is to provide a blasting tube which permits the greater use of bags in the ground to protect the charge. Waterproof bags have been used in the past where bad ground conditions are encountered to prevent water from ruining the explosive or preventing the detonation thereof. However, as far as is known, the combination of bags and an airspace positioned next thereto has never been used with a granular or pelletized explosive such as Nitro Carbon Nitrate which is known as NCN in the trade. When the present, relatively stiff blasting tubes are employed with the bag attached to the exterior of the concave side of a tube the unit can be easily inserted into the hole.

A further object of the method of the present invention is to permit the carrying out of directional blasting with little or no stemming material. Thus the time, expense, and labour involved in obtaining stemming material and transporting it to the blasting site is avoided or at least considerably reduced.

BRIEF DESCRIPTION OF THE DRAWINGS

Preferred embodiments of the invention will now be described, by way of example, with reference to the accompanying drawings, in which.

DETAILED DESCRIPTION OF PREFERRED EMBODIMENTS

Figure 1:
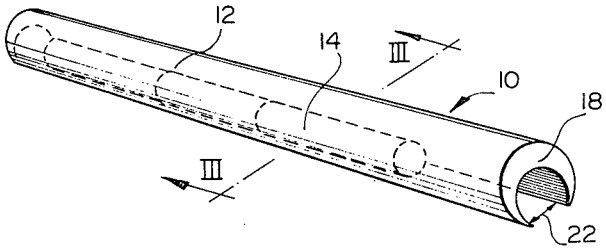
FIG. 1 is a perspective view of a first embodiment of a device for blasting material constructed in accordance with the present invention.

A blasting tube 10 according to the present invention is shown in FIG. 1 and has a substantially rigid elongated body 12. The body 12 is crescent shaped in cross section in order to accommodate cylindrical explosive charges 14 shown in dotted lines in FIG. 1. These explosive charges are of a substantial nature so as to be capable of shattering rock or similar structure and could take the form of dynamite which is normally encased in a waterproof cylindrical outer shell. As can best be seen from FIG. 3, the interior of the body 12 has an air space 16 therein which extends the length of the tube. In the preferred embodiment shown, the cross section of the air space takes the form of a crescent but it will be understood that the air space 16 can have other shapes in cross section such as a rectangular shape. Preferably, each end of the air space 16 is closed by an end wall 18 of the tube. The end walls 18 are particularly desirable where there is a possibility of the air space 16 filling up with foreign material such as water or rock dust, it being particularly desirable to maintain the air space 16 free of any other material besides air. Where there is no danger of the air space 16 being filled with such material, the end walls 18 can be omitted.

The blasting tubes 10 of the invention are preferably made from a substantially rigid plastics material. This material is relatively inexpensive and the tubes 10 of the invention can be constructed in a simple, inexpensive way, such as by extrusion. It is not necessary that the material be particularly strong for it does not have to withstand the effects of the eventual blast as long as the material is sufficiently rigid to hold its shape and to maintain the desired air space 16 in the bore hole. Preferably the body 12 should be slightly resilient in order to accommodate the cylindrical explosive charges 14 as explained hereinafter.

Figure 3:
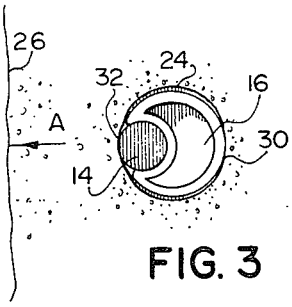
FIG. 3 is a sectional view taken along the line III—III of FIG. 1 and showing the device properly oriented in a horizontal bore hole prior to blasting.

The blasting tube 10 is provided with means for maintaining the explosive charges 14 out of the air space 16 and, in the preferred embodiment shown, the concave exterior portion 20 of the tube serves this function. It should be understood however that other means can be used to maintain the charges 14 out of the air space 16 such as transverse ribs arranged at intervals along the length of the tube. These ribs would have the same general shape and arrangement as the end walls 18 previously described. Also, in the embodiment of FIG. 1, the exterior portion 20 is adapted to hold the explosive charges 14 so that these charges can be quickly and easily attached to the tube prior to insertion thereof into the bore hole. In order to hold the charges 14, the exterior portion 20 extends about the periphery of the individual charges more than 180° as can be seen in FIG. 3 and is of such a size that it tightly grips the cylindrical charges. If the material from which the tube is made is sufficiently resilient and the gap 22 along the open side of the tube is sufficiently large, then the charges 14 or dynamite sticks can be quickly attached to the tube by shoving them sideways through the gap 22. The two edges of the tube which define the gap 22 will be shoved sufficiently apart to permit the insertion of the sticks. An alternative method of attaching the charges or dynamite sticks to the tube of the invention is the insertion of the charges one by one into one end of the tube and the shoving of each charge along the tube until it assumes its proper position therein.

Once the explosive charges have been attached as described to the tube, the device consisting of the tube and the charges can be inserted into a cylindrical bore hole 24 that has been previously drilled into the rock or other material at the desired location. Usually where directional blasting is desired, the bore hole 24 will extend in a direction parallel to the rock face 26 already in existence. It is the object of the directional blast to remove the rock or other material between the face 26 and the present bore holes 24 so that a clean, relatively smooth rock face is formed such as that shown at 28 in FIG. 5. During the insertion process or immediately after insertion has been accomplished, the tube 10 and explosive charges 14 are oriented in the bore hole so that they assume the position shown in FIG. 3. As can be seen, the air space 16 forms an air cushion between the explosive charge 14 and one side 30 of the bore hole. Since the maximum breaking and shattering forces are desired in the direction of the arrow A, the air cushion is oriented in the direction relative to the explosive charge 14 opposite to which the maximum breaking and shattering forces are desired.

Preferably, the total diameter of the combination of the charges 14 and the tube 10 is slightly greater than the diameter of the bore hole 24. This is possible because of the slight resiliency of the tube 10 which permits the charges 14 to be shoved slightly towards the center of the tube 10 as the tube and charges are being inserted into the hole. Thus, when insertion and orientation of the tube has been accomplished, the charges 14 will be held with a slight pressure against the adjacent side 32 of the hole. Thus, even though the weight of the charge may be considerably greater than that of the tube, the friction created between the sides of the bore hole and the tube and the charges by this slight pressure will prevent the charges 14 from simply dropping to the bottom side of the hole under the force of gravity. However, when the charge is detonated, the full force of the blast will be felt along the side 32 of the bore hole because of the close contact between the charges and this side. It should be understood of course that before detonation takes place, the outer end of the bore hole can be firmly plugged in the usual manner to prevent some effect of the blast being lost by gases escaping through the open end of the bore hole.

Figure 5:
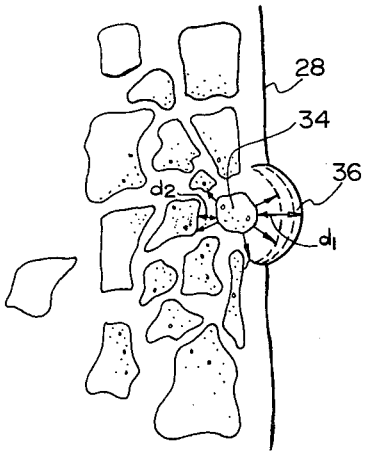
FIG. 5 is a view similar to FIG. 3 illustrating what occurs the instant after detonation.

What occurs when detonation takes place is shown schematically in FIG. 5 wherein the center of the blast is shown at 34. The blasting tube, which in most cases would be destroyed or collapsed by the blast is shown in chain lines at 36. The instant after detonation the force of the expanding gases is greatest and the force of these gases extends in all directions. However, in order for the force of these gases to effect the rock behind the rock face 28, they must first fill the air space 16 created by the blasting tube. Thus the full force of the blast is not immediately felt by this rock while it is felt by the rock in the direction of the existing rock face 26. In this way, the rocks located between rock faces 26 and 28 begins to shatter first and the space around the center of the blast 34 grows somewhat. As shown in FIG. 5, the radius of the area feeling the full force of the blast has grown by the distance $d_2$ in the direction of the former rock face 26 in the time that the full force of the blast is felt across the distance $d_1$ in the direction of the former air space 16. Thus, the room for the gases created by the explosion has grown and this results in a decrease in the pressures created by these gases. The rock behind the rock face 28 is thus saved because it never feels the full force of the blast unlike the rock in front of this rock face.

Figure 2:
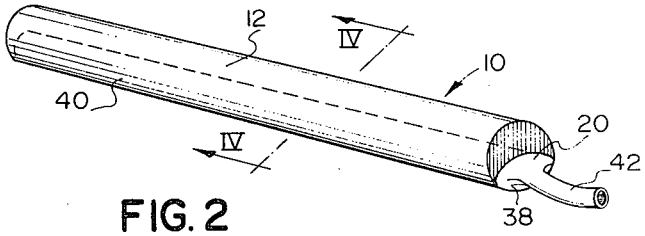
FIG. 2 is a perspective view of a second embodiment of a device for blasting material constructed in accordance with the present invention.
Figure 4:
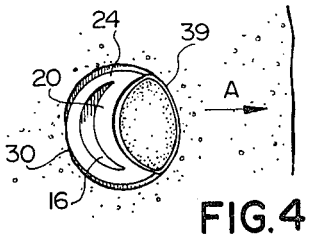
FIG. 4 is a sectional view taken along the line IV—IV of FIG. 2 and showing the device with the bag now filled with explosive and the device properly oriented in a horizontal bore hole prior to blasting.

In the embodiment of the invention shown in FIG. 2, the blasting tube 10 again has a body 12 with a crescent-shaped cross section, best seen in FIG. 4. Again, the interior of the tube has an air space 16 which is preferably crescent-shaped. However, unlike the tube of FIG. 1, this embodiment has an elongated bag 38 attached to its exterior and extending the length of the tube. This bag 38 extends across the gap formed by the concave exterior portion 20 of the tube and is attached along each of its long edges 40 to the tube. One end of the bag can be provided with a filling tube or pipe 42 which communicates with the interior of the bag. The bag is preferably made of a water proof material such as polyethylene in order to prevent water from ruining the explosive charge to be placed in the bag.

Figure 6:
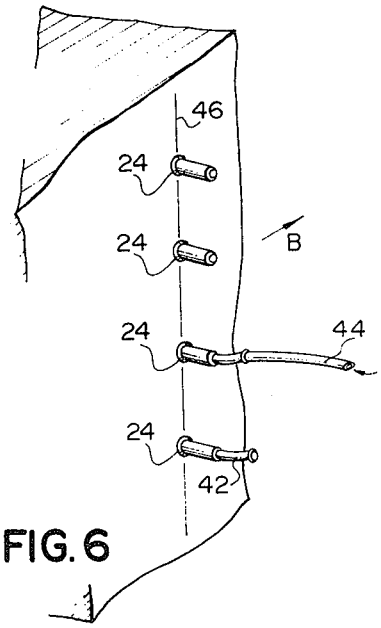
FIG. 6 is a perspective view of a rock face showing several blasting tubes of the invention in place prior to detonation.

In use, the tube and bag shown in FIG. 2 are inserted without the explosive charge into the bore hole 24 as shown in FIG. 4. Because the total diameter of the tube and unfilled bag need not be as great as the bore hole 24, this embodiment of the invention has the advantage of being insertable quickly and easily into the bore hole. After insertion is accomplished, the outer end of the tube preferably extends a short distance out of the bore hole 24 as shown in FIG. 6. Thus, it is never difficult to properly orient the tube in the hole or to maintain the tube in the proper position while the filling operation described hereinafter takes place. The air space 16 is again arranged between the bag which is to hold the explosive charge and one side 30 of the bore hole. As shown in FIG. 4, the maximum breaking and shattering forces is desired in the direction indicated by the arrow A so that the air space 16 is located in a direction relative to the bag 38 opposite to the direction A. Once the tube is in position and properly oriented, the bag 38 can be filled with a granular explosive such as NCN in the manner indicated in FIG. 6. The granular explosive is fed through a conduit 44 under pressure and in a known manner into the pipe 42 and from there into the bag 38. It it well known to those skilled in the art to fill a cavity or bore hole with a granular explosive by means of a pneumatic process or compressed air. Therefore, further description of the bag filling operation is deemed to be unnecessary. As the bag 38 fills with explosive, it expands to fill the space between the concave exterior portion 20 of the tube and the adjacent side of the bore hole. After the filling operation is completed, the conduit 44 is disconnected and the outer end of the bore hole is plugged as usual. The filling operation results in the tube and explosive charge being wedged in the bore hole so that proper orientation of the tube and air space is maintained until detonation occurs.

Turning again to FIG. 6, it will be seen that the top two bore holes 24 are filled with blasting tubes of the type shown in FIG. 1 while the bottom two holes are filled with tubes of the type shown in FIG. 2. With the orientation of the tubes as shown in FIG. 6, the force of the blast will be directed in the direction of the arrow B and a relatively smooth rock face will be formed approximately along the line indicated at 46, this face being generally parallel to the rock face 26. It will be understood of course that normally tubes of only one type will be used at any one time and the two types of tubes are shown in FIG. 6 merely for purposes of illustration.

Because it is not necessary for the tube of FIGS. 2 and 4 to hold or contain a cylindrical explosive charge 14, it is not necessary for the concave exterior portion 20 to extend along a circular arc of more than 180°. It should also be understood that it is not necessary in all cases for the bags 38 to be waterproof nor is it even necessary for a bag 38 to be used. A non-waterproof bag can be usefully employed in areas where water is not a problem in order to prevent the explosive material from undesirably filling any cracks or spaces in the vicinity of the bore hole which might have been created by previous blasting. Also, if the air space 16 is not completely enclosed by the blasting tube body 12, the use of a bag will prevent the powder explosive from entering into and possibly filling the air space 16. However, it should be clearly understood that the bags 38 are not essential when granular explosives such as NCN is being used, particularly where the bore hole clearly would not have any cracks or spaces in its vicinity. As long as the air space 16 is sealed so that the explosive cannot enter into it, the granular explosive can simply be blown into the space between the concave exterior portion 20 and the adjacent side of the bore hole. The usual methods and devices can be used to detonate the explosive charges but if a tape fuse is employed, the plastics material of the blasting tubes should be chosen so that it can withstand the heat created by the fuse. There are already plactics used in the blasting art which are suitable and which can withstand the heat of such a fuse.

When using the tubes of the present invention, it is obvious that either a larger hole than normal must be drilled to accommodate both the tube and the explosive charge or a greater number of holes must be drilled in order to obtain the same blasting effectiveness. If the same size of hole is used as would be used if no blasting tubes were employed, then clearly the diameter of the charges must be smaller than those normally employed in order that there is sufficient space for the tubes. Since the size of the charge is made smaller, this must be compensated for by drilling a greater number of holes. However, it is felt that the need to drill a greater number of holes is offset by the fact that the ground remaining after the blast has much fewer fractures in it and is therefore much more suitable for the intended purpose. Also, the amount of overbreak would be reduced, resulting in a lowering of the cost of removal of the overbreak to a suitable location. At least in mining and tunneling operations, there would also be a reduction in the cost of timbering and/or roof bolting and the amount of time required for these operations. In mining operations particularly, considerable advantage can be gained by its use because the amount of available ore could be increased by the use of the present blasting tubes. In all underground mining operations, the width that can be excavated or tunnelled at any one location is limited for safety reasons because of the danger of cave-inns. If the walls and the roof of the mining tunnel have not been fractured by the blast of the mining operation, then there is obviously less danger of cave inns and the walls are better able to withstand the great pressures encountered underground. Also, where the blasting tubes of the invention are used to form the bottom or floor of the mine tunnel, a smoother floor will be formed and this floor can then provide a smooth roadway for trackless mining.

It is also possible to use the blasting tube 10 shown in FIGS. 2 and 4 without the bag 38 and in conjunction with explosive charges consisting of individual cylindrical elements such as those indicated in FIG. 1. When using this combination, the blasting tube is inserted into the bore hole first without the explosive charges attached thereto. After the tube has been properly oriented in the hole, the cylindrical charges or dynamite sticks are slid into the hole in the space between the concave exterior portion 20 and the opposite side of the hole. The tube is sufficiently resilient or springy to permit the charges to be pushed into the hole. However, when in place, the charges are held against the desired side of the hole by the tubes. The outer end of the hole is then plugged and the charge is detonated in the usual manner.

When working in underground locations, care must be taken to ensure that the material is chosen so that the fumes, formed by it after detonation occurs, are within the limits set by the Bureau of Mines Act or similar legislation.

What I claim as my invention is:

1. A method of blasting material comprising the steps of inserting into a bore hole a means for directing the blast of an explosive charge in the material to be blasted, said means being an elongated, substantially rigid tube having a cresent-shaped exterior cross-section and an explosive charge extending therealong, said rigid tube having an air space therein extending substantially the length thereof, said air space being cresent-shaped in cross-section and being oriented in said hole between said explosive charge and one side of said bore hole in a direction relative to said explosive charge opposite that in which the maximum breaking and shattering forces are desired to be directed, and, while said means is still in said bore hole, detonating said explosive charge.

2. A method as claimed in claim 1 wherein said explosive charge consists of individual elements of cylindrical form.

3. A method as claimed in claim 1 wherein the explosive charge is contained in one or more bags.

4. A method of blasting material according to claim 1 wherein said air space is enclosed by said tube along the length of said tube.

5. A method of blasting material according to claim 4 wherein said air space is completely enclosed including both ends thereof.

6. A method of blasting material comprising the steps of inserting into a bore hole a means for directing the blast of an explosive charge in the material to be blasted, said means being an elongated, substantially rigid tube and cylindrical sticks of explosive, said tube having an inner wall in the shape of a circular arc in cross-section and extending snuggly about the periphery of each stick more than 180° relative to the centre axis of said sticks, said tube also having an outer wall in the shape of a circular arc in cross-section of greater radius than that of said inner wall, said inner and outer walls being joined at their side edges, a cresent-shaped air space being formed between said inner and outer walls and extending substantially the length of said tube, the air space in said tube being oriented in said hole directly between said sticks and one side of said bore hole in a direction relative to said sticks opposite that in which the maximum breaking and shattering forces are desired to be directed, and while maintaining said tube in said hole, detonating said explosive.

7. A method of blasting material comprising the steps of inserting a means for directing the blast of an explosive charge into a bore hole in the material to be blasted, said means being an elongated, substantially rigid tube and an elongated bag extending along said tube and being adapted to contain a substantial explosive charge, said tube having an inner wall in the shape of a circular arc in cross-section and an outer wall in the shape of a circular arc in cross-section, said inner and outer walls being joined at their side edges, an air space being formed between said inner and outer walls and extending substantially the length of said tube, the air space in said tube being oriented in said hole directly between the bag and one side of said bore hole in a direction relative to said bag opposite that in which the maximum breaking and shattering forces are desired to be directed, filling said bag with a substantial explosive charge, and while maintaining said tube in said hole, detonating said charge.

8. A method of blasting material according to claim 7 wherein said explosive charge is in granular or powder form and is blown into said bag to fill said bag and thus a space in said hole adjacent said concave exterior portion.

9. A blast directing means for use in a drill hole for directing the force of an explosive blast from an explosive charge used to shatter rock or similar structure, said blast directing means being a tube having a substantially rigid elongated hollow body the exterior cross-section of which is crescent-shaped and is defined by a concave exterior portion and a convex exterior portion, and having a longitudinal air space therein the cross-section of which is crescent-shaped, and explosive charge holding means extending along the tube in the hollow of the concave exterior portion for holding the explosive charge and maintaining said explosive charge out of said air space, said holding and maintaining means including said concave exterior portion of the blasting tube.

10. A blast directing means according to claim 9 wherein said substantially rigid elongated body is made of plastic.

11. A blast directing means according to claim 9, wherein the concave exterior portion of the crescent shaped blasting tube is adapted to hold an explosive charge in cylindrical form.

12. A blast directing means according to claim 9 wherein said body encloses said air space along the entire length thereof.

13. A blast directing means according to claim 8 wherein said air space is completely enclosed including both ends thereof.

14. A blast directing means according to claim 9 further comprising an elongated explosive charge attached to the exterior thereof.

15. A blast directing means according to claim 14 wherein said explosive charge is formed of individual elements of cylindrical form, said elements being attached to said tube by the concave exterior portion of the tube which extends about the periphery of said elements more than 180°.

16. A blast directing means according to claim 14 wherein said explosive charge is in powder granular or fluid form in one or more bags, said bag or bags being attached adjacent the concave exterior portion of said tube.

17. A blast directing means according to claim 14, including an elongated bag attached to said body and located adjacent the concave exterior portion of said body.

18. A blast directing means for use in a drill hole for directing the force of an explosive blast, said blast directing means comprising a tube having inner and outer walls each in the form of a circular arc in cross-section and joined to each other at their side edges, the radius of said outer wall being greater than that of said inner wall, a crescent-shaped air space being formed between said inner and outer walls and extending substantially the length of said tube, said inner wall extending circumferentially about its longitudinal centre axis more than 180° for accommodating snuggly cylindrical sticks of explosive immediately adjacent the outside surface of said inner wall.

19. A blast directing means according to claim 18 wherein said tube is made of plastic.

20. A blast directing means according to claim 19 wherein said walls are resilient for permitting said sticks of explosive to be inserted from the side of the tube to their position immediately adjacent the inner wall.

21. A blast directing means for use in a drill hole for directing the force of an explosive blast, said blast directing means comprising a tube having inner and outer walls joined to each other at their side edges, said outer wall at least having the shape of a circular arc in cross-section, said walls being spaced to define an air space between them and extending substantially the length of said tube, and an elongated bag attached to said tube adjacent the exterior of said inner wall and adapted to be filled with a flowable explosive charge, said bag being attached to said tube at each of two longitudinal side edges of said bag in the region of said tube where the inner and outer walls are joined.

22. A blast directing means according to claim 21 wherein said air space is crescent-shaped.

23. A blast directing means according to claim 22 wherein said tube is made of plastic.

* * * * *